US010045598B2

(12) United States Patent
Lin

(10) Patent No.: US 10,045,598 B2
(45) Date of Patent: Aug. 14, 2018

(54) CONTACT LENS CASE STRUCTURE THAT PROVIDES CONVENIENT ACCOMMODATION, CLEANING AND ACCESSING OF CONTACT LENSES

(71) Applicant: BONASSE ENTERPRISES CO., LTD., Taoyuan (TW)

(72) Inventor: Ta-Chin Lin, Taoyuan (TW)

(73) Assignee: BONASSE ENTERPRISES CO., LTD., Taoyuan (TW)

( * ) Notice: Subject to any disclaimer, the term of this patent is extended or adjusted under 35 U.S.C. 154(b) by 0 days.

(21) Appl. No.: 15/450,002

(22) Filed: Mar. 5, 2017

(65) Prior Publication Data

US 2017/0172269 A1 Jun. 22, 2017

Related U.S. Application Data

(63) Continuation-in-part of application No. 15/155,078, filed on May 16, 2016.

(30) Foreign Application Priority Data

Sep. 4, 2015 (TW) ..... 104214397 A

(51) Int. Cl.
*A45C 11/00* (2006.01)

(52) U.S. Cl.
CPC ..... *A45C 11/005* (2013.01)

(58) Field of Classification Search
CPC ..... A45C 11/005; Y10S 134/901
USPC ..... 206/5.1, 6, 205, 210; 134/6, 137; 422/301
See application file for complete search history.

(56) References Cited

U.S. PATENT DOCUMENTS 3,101,087 A * 8/1963 Watson ..... A45C 11/005 134/143
3,378,020 A * 4/1968 Grabiel ..... A45C 11/005 134/156
3,460,552 A * 8/1969 Sturgeon ..... A45C 11/005 134/135
3,977,517 A * 8/1976 Kadlecik ..... A45C 11/005 206/205
5,365,630 A * 11/1994 Beckrich ..... G02C 13/008 15/104.92
6,086,823 A * 7/2000 Bourset ..... A45C 11/005 134/901

(Continued)

*Primary Examiner* — Chun Cheung
*Assistant Examiner* — Brijesh V. Patel
(74) *Attorney, Agent, or Firm* — Leong C. Lei

(57) ABSTRACT

The contact lens case structure includes a main body, a number of elastic members, a number of carrier members, a number of cover members, and a number of hollowed-out pressing members. The main body has a number of accommodation spaces. Each elastic member is housed in an accommodation space. A contact lens is placed on a carrier member which in turn is placed on an elastic member. Each pressing member is housed inside a cover member. Each accommodation space is filled with solution. Each cover member is joined to an accommodation space. Each pressing member presses a top side of a carrier member, which in turn compresses an elastic member so that the contact lens is immersed in the solution. The contact lens is held between the pressing member and the carrier member with enhanced cleaning and sterilization effect and is prevented from deformation.

4 Claims, 6 Drawing Sheets

(56) References Cited

U.S. PATENT DOCUMENTS

| | | | | |
|---|---|---|---|---|
| 8,123,028 | B2 * | 2/2012 | Doniga | A45C 11/005 116/270 |
| 2010/0072082 | A1 * | 3/2010 | Kang | A45C 11/005 206/5.1 |

* cited by examiner

CONTACT LENS CASE STRUCTURE THAT PROVIDES CONVENIENT ACCOMMODATION, CLEANING AND ACCESSING OF CONTACT LENSES

RELATED APPLICATION

This application is a continuation-in-part of U.S. patent application Ser. No. 15/155,078, filed May 16, 2016, which application is incorporated by reference herein in its entirety.

BACKGROUND OF THE INVENTION (a) Technical Field of the Invention

The present invention relates to a contact lens case structure that provides convenient accommodation, cleaning, and accessing of contact lenses.

(b) Description of the Prior Art

To maintain a normal visual function effectively, near-sighted people will wear glasses. But, many people like to wear contact lenses instead of glasses with frames for the sake of appearance and convenience. However, wearing contact lenses for an extended period of time would lead to corneas hypoxia and further to corneas damage. For this reason, contact lenses must be removed and cleaned after a period of usage so as to be used again.

The most common cleaning method is to place contact lenses in cases, fill the cases with cleaning solutions, rub the lenses with fingers so as to remove the dust, protein deposit, mucus, grease stain, etc., and to maintain the oxygen permeability of the lenses.

For a conventional contact lens case, the lens is stored and immersed in an accommodation space of the case body. To use the lens, usually a clip is employed to remove the lens from the accommodation space. However, for a user without his/her glasses, it would take some time to precisely clip the lens as the lens and the solution are similar in color. Therefore, there is still room for improvement for the conventional contact lenses case.

SUMMARY OF THE INVENTION

The contact lens case structure includes a main body, a number of elastic members, a number of carrier members, a number of cover members, and a number of hollowed-out pressing members. The main body includes a number of accommodation spaces, each having threads along an outer circumference, a number of limiting slots along an inner wall, and two protrusions on a bottom side, of the accommodation space;

Each elastic member is housed in an accommodation space and includes a first elastic element and a second elastic element. The first and second elastic elements respectively have first and second bottom sections and first and second elastic sections. The first and second bottom sections respectively have through openings and, along an edge, first and second fastening sections. A first elastic element is joined to a second elastic element into an elastic member by locking their first and second fastening sections together. When an elastic member is placed in an accommodation space, the protrusions are plugged into the through openings.

The first and second elastic sections are respectively extended upward in a counterclockwise manner from the first and second bottom sections. The first and second elastic sections respectively have first and second locking grooves at top ends and first limiting elements at bottom ends. The first limiting elements are for embedment in corresponding limiting slots.

Each carrier member is disposed on an elastic member. Each carrier member includes a ring section and a hollowed-out carrier section surrounded by the ring section. A number of radially outward protruding second limiting elements are configured along the ring section for embedment into corresponding limiting slots. A number of downward extending locking elements are configured along the ring section for locking with corresponding first and second locking grooves. The carrier section has an upward bulging semi-spherical shape for the placement of a contact lens and has a height higher than that of the ring section.

Each cover member has threads around an inner wall corresponding to those around the accommodation spaces so that each cover member is screw-joined to and seals an accommodation space and a number of joining slots inside the cover member.

Each pressing member is housed in a cover member and has a number of joining pieces extended upward from a top side for embedment into the joining slots. When a cover member is joined to the main body, a bottom side of the pressing member inside the cover member presses against the ring section of the carrier member, which in turn compress the elastic member.

To use the case structure, the accommodation space is filled with solution and is sealed by a cover member. The pressing member presses the carrier member, which in turn compresses the elastic member so that the contact lens is immersed in the solution. The contact lens is held between the pressing member and the carrier member with enhanced cleaning and sterilization effect and is prevented from deformation.

Preferably, a ring-shaped stopping wall is configured on a top side of each carrier member between the ring section and the carrier section; and two oppositely positioned handle elements are configured on each stopping wall. Preferably, each first fastening section includes a first semi-circular notch and a first semi-circular block. Each second fastening section includes a second semi-circular notch and a second semi-circular block. When a first elastic element is joined to a second elastic element into an elastic member, the second semi-circular block is plugged into the first semi-circular notch, and the first semi-circular block is plugged into the second semi-circular notch.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
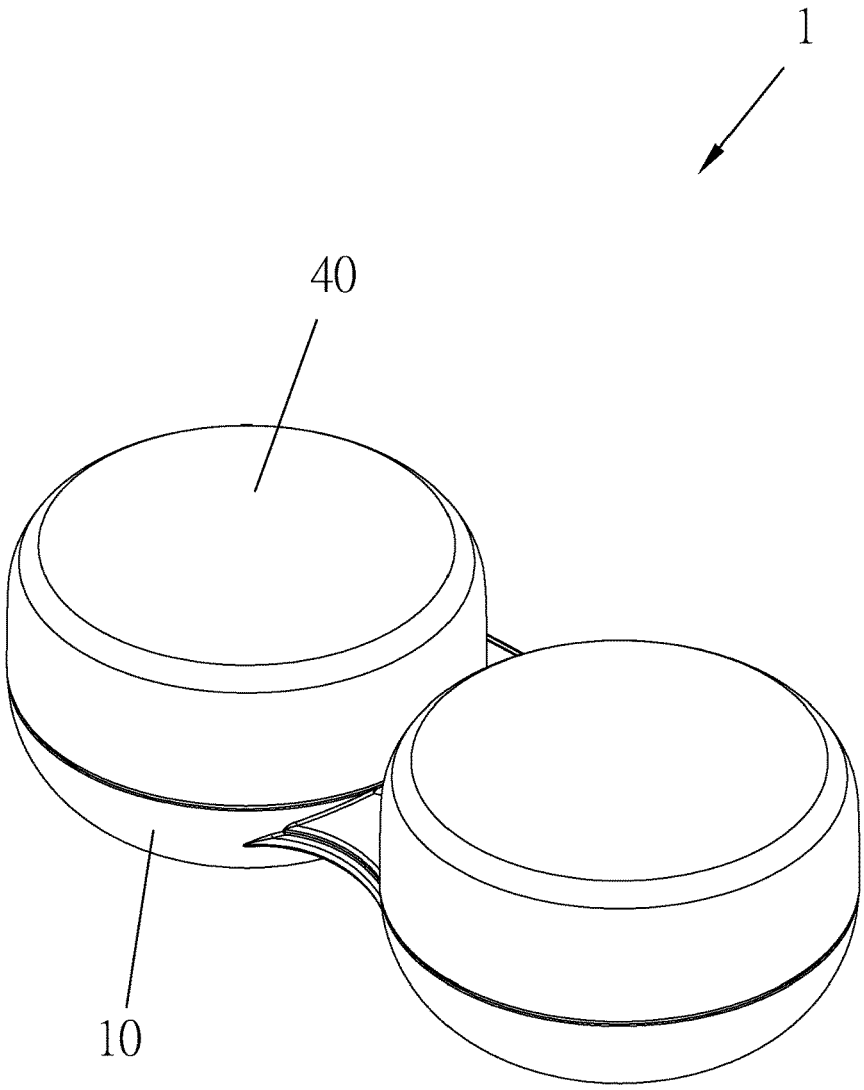
FIG. 1 is a perspective view of a contact lens case structure according to an embodiment of the present invention.
Figure 2:
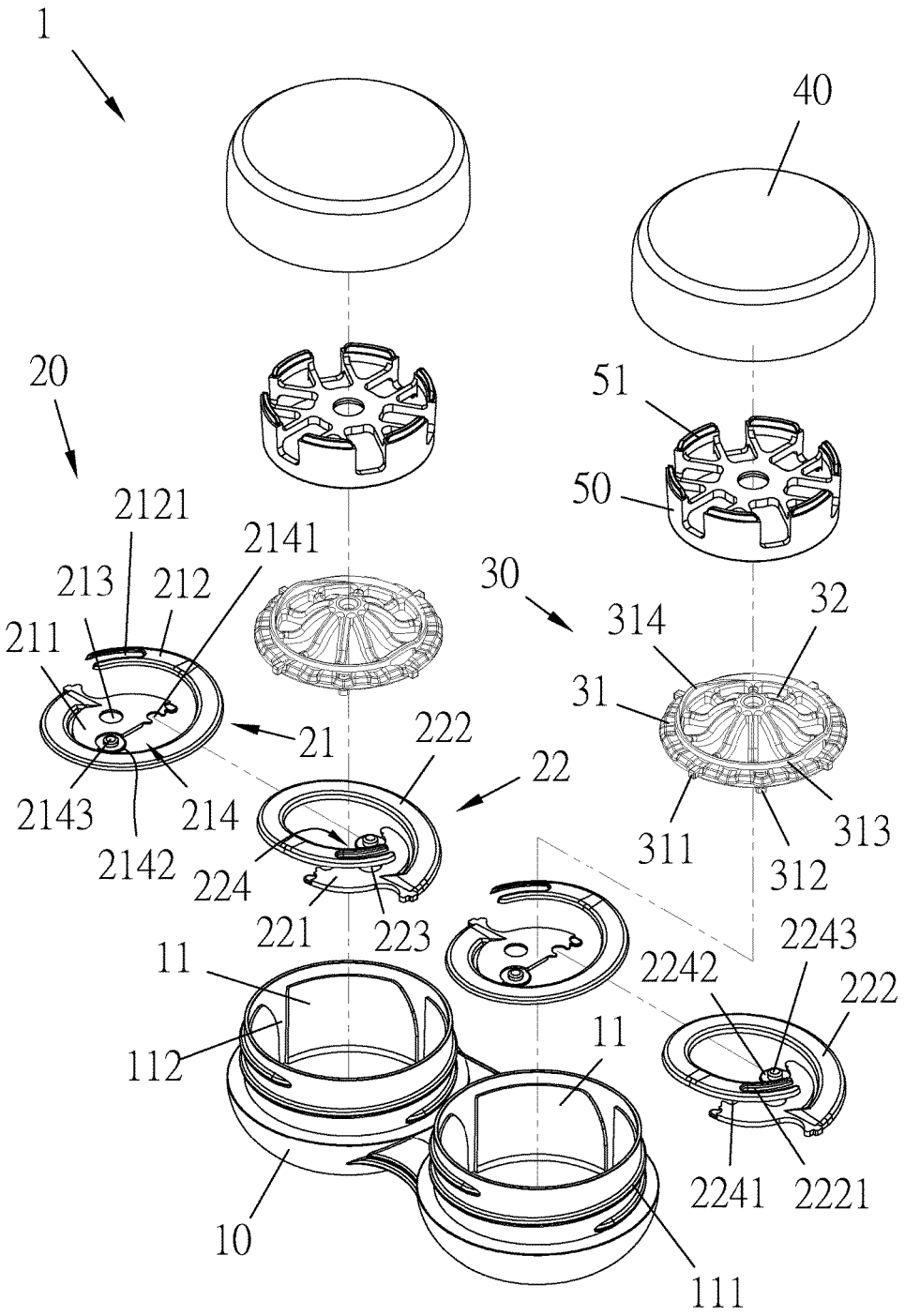
FIG. 2 is an exploded view of the contact lens case structure of FIG. 1.

As shown in FIGS. 1 and 2, a contact lens case structure 1 according to an embodiment of the present invention mainly includes a main body 10, a number of elastic members 20, a number of carrier members 30, a number of cover members 40, and a number of hollowed-out pressing members 50.

As shown in FIG. 2, the main body 10 includes a number of accommodation spaces 11. Each accommodation space 11 has threads 111 along an outer circumference, a number of limiting slots 112 along an inner wall, and two protrusions 113 on a bottom side, of the accommodation space 11.

Figure 3:
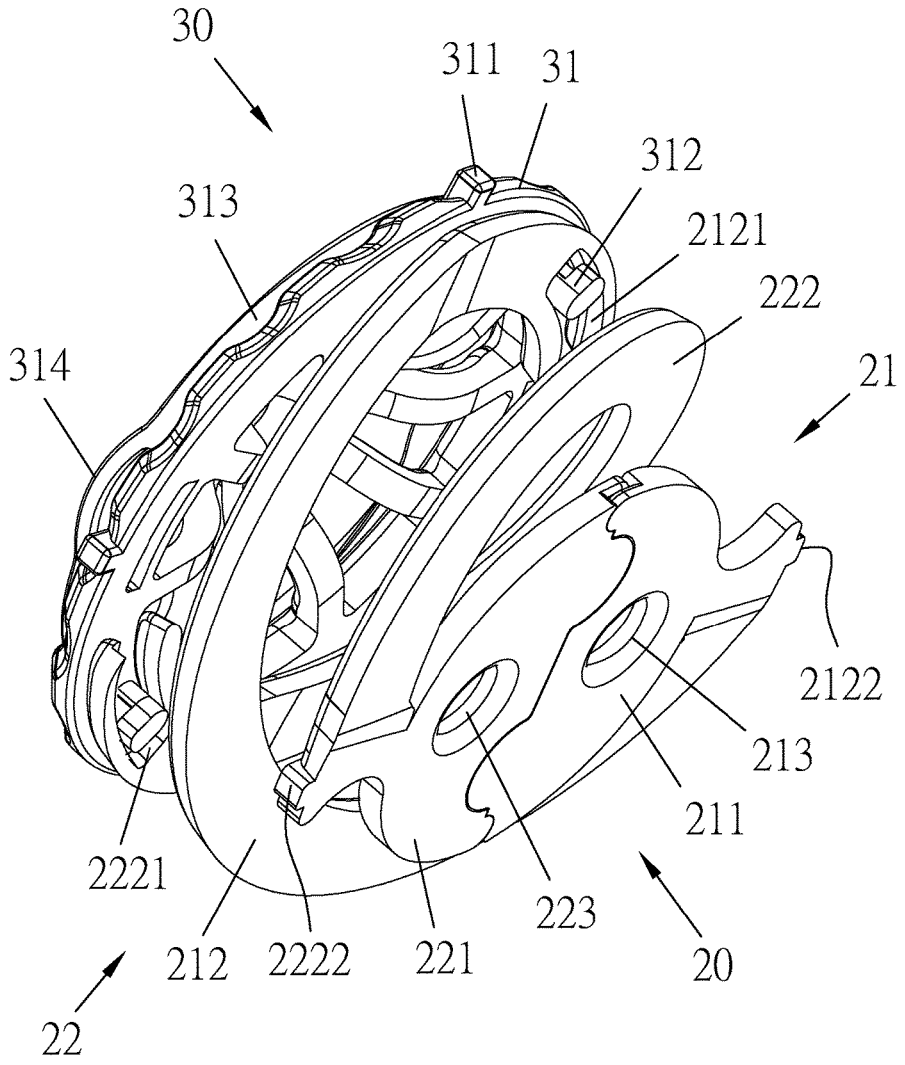
FIG. 3 is a perspective view of an elastic member and a carrier member of the contact lens case structure of FIG. 1.

As shown in FIGS. 2 and 3, each elastic member 20 is housed in an accommodation space 11. Each elastic member 20 includes a first elastic element 21 and a second elastic element 22. The first and second elastic elements 21 and 22 have first and second bottom sections 211 and 221, and first and second elastic sections 212 and 222, respectively. The first and second bottom sections 211 and 221 have through openings 213 and 223, and first and second fastening sections 214 and 224, respectively. A first elastic element 21 is joined to a second elastic element 22 into an elastic member 20 by locking their first and second fastening sections 214 and 224 together. When an elastic member 20 is placed in an accommodation space, the protrusions 113 are plugged into the through openings 213 and 223.

Each first fastening section 214 includes a first semi-circular notch 2141, and a first semi-circular block 2142. Each second fastening section 224 includes a second semi-circular notch 2241 and a second semi-circular block 2242. When a first elastic element 21 is joined to a second elastic element 22 into an elastic member 20, the second semi-circular block 2242 is plugged into the first semi-circular notch 2141, and the first semi-circular block 2142 is plugged into the second semi-circular notch 2241.

The first semi-circular block 2142 has a height lower than that of the first bottom section 211. A first pin 2143 is configured on the first semi-circular block 2142 for plugging into the second semi-circular notch 2241. The second semi-circular block 2242 has a height lower than that of the first bottom section 221. A second pin 2243 is configured on the second semi-circular block 2242 for plugging into the first semi-circular notch 2141.

The first and second elastic sections 212 and 222 are extended upward in a counterclockwise manner from the first and second bottom sections 211 and 221, respectively. The first and second elastic sections 212 and 222 have first and second locking grooves 2121 and 2221 at top ends, and first limiting elements 2122 and 2222 at bottom ends, respectively. The first limiting elements 2122 and 2222 are for embedment into corresponding limiting slots 112.

In other words, after the first and second elastic elements 21 and 22 are joined together, the first and second elastic sections 212 and 222 are interleaved into a spiral and therefore jointly function like a spring.

Figure 4:
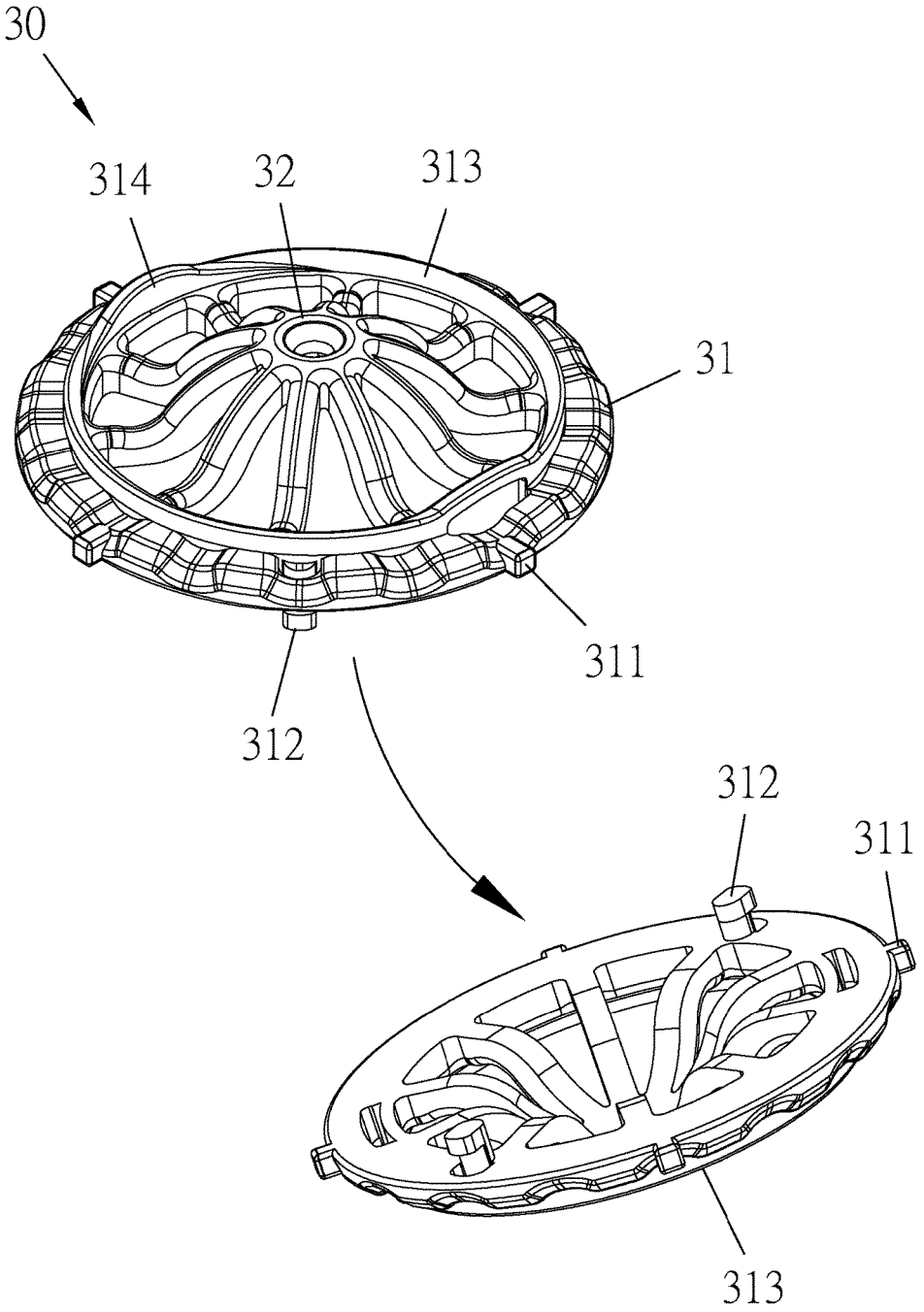
FIG. 4 provides two perspective views of a carrier member of the contact lens case structure of FIG. 1.

As shown in FIGS. 2 to 4, each carrier member 30 is disposed on an elastic member 20 and includes a ring section 31 and a hollowed-out carrier section 32 surrounded by the ring section 31. A number of radially outward protruding second limiting elements 311 are configured along the ring section 31 for embedment into corresponding limiting slots 112. A number of downward extending locking elements 312 are configured along the ring section 31 for locking with corresponding first and second locking grooves 2121 and 2221. The carrier section 32 has an upward bulging semi-spherical shape for the placement of a contact lens (not shown) and therefore has a height higher than that of the ring section 31.

A ring-shaped stopping wall 313 is configured on a top side of each carrier member 30 between the ring section 31 and the carrier section 32, and two oppositely positioned handle elements 314 are configured on the stopping wall 313.

Figure 5:
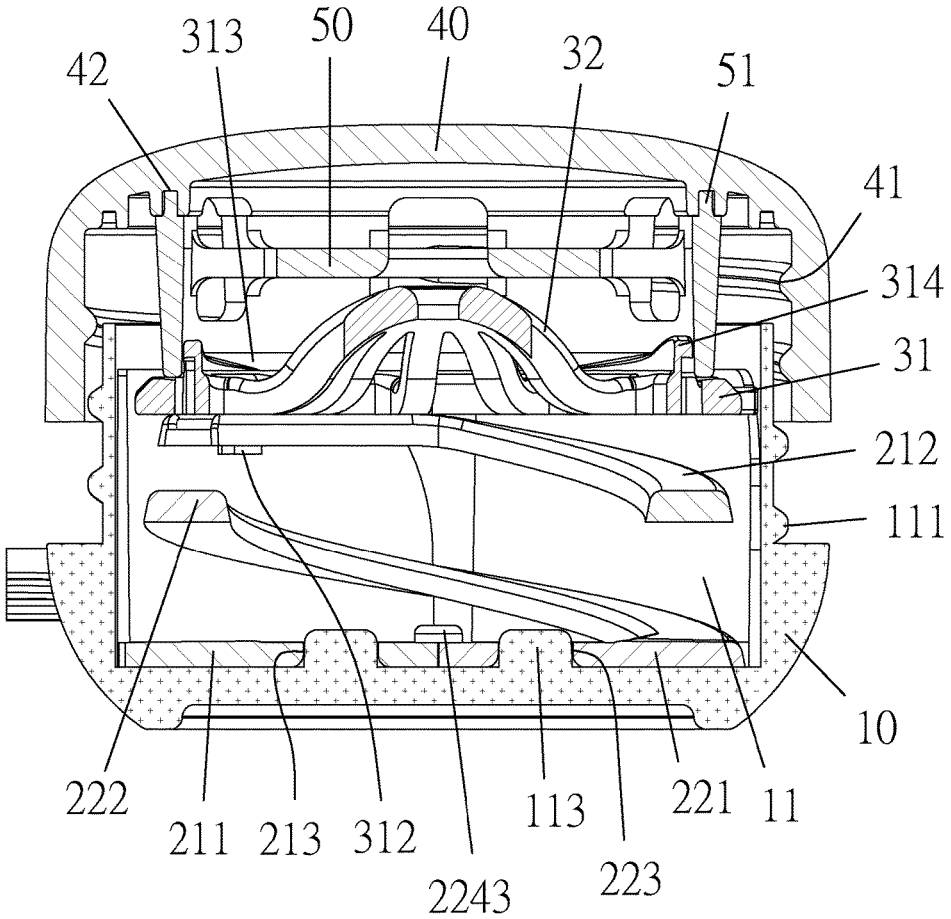
FIG. 5 is a sectional view of the contact lens case structure of FIG. 1 when the case structure is about to be opened.

As shown in FIG. 5, each cover member 40 has threads 41 around an inner wall corresponding to the threads 111 so that each cover member 40 may be screw-joined to the main body 10 to seal an accommodation space 11. Inside each cover member 40, a number of joining slots 42 are configured.

As shown in FIGS. 2 and 5, each pressing member 50 is housed in a cover member 40 and has a number of joining pieces 51 extended upward from a top side for embedment into the joining slots 42, respectively. When the cover member 40 is joined to the main body 10, a bottom side of the pressing member 50 inside the cover member 40 presses against the ring section 31.

Figure 6:
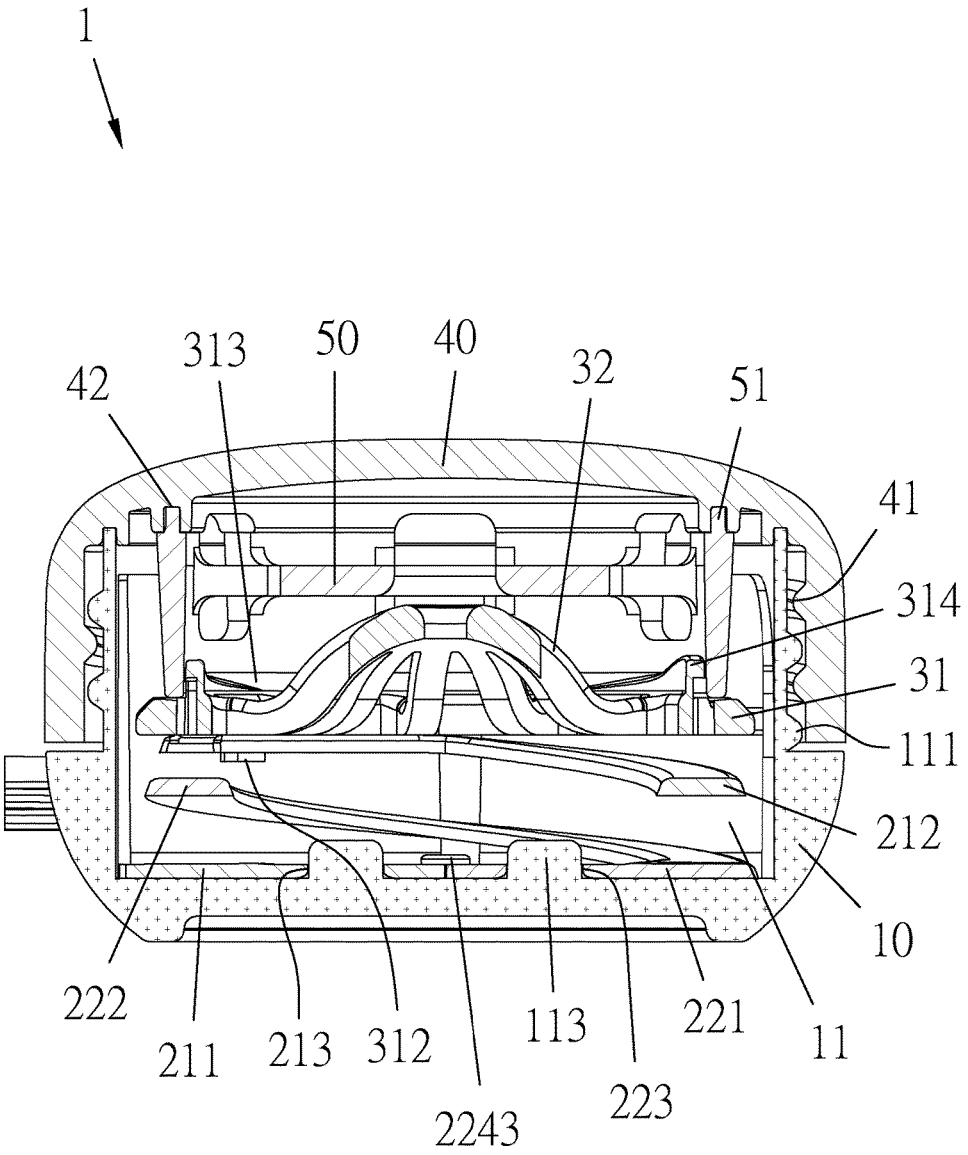
FIG. 6 is a sectional view of the contact lens case structure of FIG. 1 when the case structure is fully closed.

As shown in FIGS. 5 and 6, to use the contact lens case structure, a contact lens (not shown) is placed on the carrier section 32 of a carrier member 30, and the accommodation place 11 is filled with contact lens solution (not shown). Then a cover member 40 is applied to seal the accommodation space 11. A pressing member 50 inside the cover member 40 pushes the ring section 31 of the carrier member 30, thereby compressing the elastic member 20 and immersing the contact lens in the solution. The contact lens is held reliably between the carrier section 32 and the pressing member 50 in a spread, non-curled, manner. The contact lens, therefore, is not affected in any way when the case structure is carried and shook or flipped. The contact lens also enjoys superior cleaning effect.

In addition, the handle elements 314 facilitate the removal of the carrier member 30 and the elastic member 20 single-handedly using the thumb and the index finger.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A contact lens case structure, comprising:

a main body comprising a plurality of accommodation spaces, each of the accommodation spaces having threads along an outer circumference, a plurality of limiting slots along an inner wall, and two protrusions on an inner side of a bottom side;

a plurality of elastic members, each housed in each of the accommodation spaces, where each of the elastic members comprises a first elastic element and a second elastic element, the first and second elastic elements respectively have first and second bottom sections and first and second elastic sections, the first and second bottom sections respectively have through openings and first and second fastening sections, the first elastic element is joined to the second elastic element into an elastic member by locking their first and second fastening sections together, and, when the elastic member is placed in one of the accommodation spaces, the two protrusions are plugged into the through openings, the first and second elastic sections are respectively extended upward in a counterclockwise manner from the first and second bottom sections, the first and second elastic sections respectively have first and second locking grooves at top ends and first limiting elements at bottom ends, the first limiting elements are for embedment in the plurality of limiting slots;

a plurality of carrier members, each disposed on each of the elastic members where each carrier member comprises a ring section and a hollowed-out carrier section surrounded by the ring section, a plurality of radially outward protruding second limiting elements are configured along the ring section for embedment into the plurality of limiting slots, a plurality of downward extending locking elements are configured along the ring section for locking with the first and second locking grooves, the carrier section has an upward bulging semi-spherical shape for the placement of a contact lens and has a height higher than that of the ring section;

a plurality of cover members, each of the cover members having threads around an inner wall corresponding to those around the accommodation spaces so that each cover member is screw-joined to and seals each of the accommodation spaces, and a plurality of joining slots inside the cover member; and a plurality of hollowed-out pressing members, each of the hollowed-out pressing members housed in each one of the cover members and having a plurality of joining pieces extended upward from a top side for embedment into the joining slots, and, when a cover member is joined to the main body, a bottom side of the pressing members inside the cover members presses against the ring section.

2. The contact lens case structure according to claim 1, wherein a ring-shaped stopping wall is configured on a top side of each of the carrier members between the ring section and the carrier section; and two oppositely positioned handle elements are configured on each stopping wall.

3. The contact lens case structure according to claim 1, wherein each first fastening section comprises a first semi-circular notch and a first semi-circular block; each second fastening section comprises a second semi-circular notch and a second semi-circular block; and, when the first elastic element is joined to the second elastic element into the elastic member, the second semi-circular block is plugged into the first semi-circular notch, and the first semi-circular block is plugged into the second semi-circular notch.

4. The contact lens case structure according to claim 3, wherein the first semi-circular block along a first bottom section has a height lower than that of the first bottom section; a first pin is configured on the first semi-circular block for plugging into the second semi-circular notch; the second semi-circular block along a second bottom section has a height lower than that of the second bottom section; and a second pin is configured on the second semi-circular block for plugging into the first semi-circular notch.

* * * * *